US006563406B2

(12) United States Patent
Beatty et al.

(10) Patent No.: US 6,563,406 B2
(45) Date of Patent: May 13, 2003

(54) MULTI-POLE CIRCUIT BREAKER WITH PARALLEL CURRENT

(75) Inventors: William Ellsworth Beatty, Beaver, PA (US); Roger Eugene Walker, Fombell, PA (US)

(73) Assignee: Eaton Corporation, Cleveland, OH (US)

( * ) Notice: Subject to any disclaimer, the term of this patent is extended or adjusted under 35 U.S.C. 154(b) by 22 days.

(21) Appl. No.: 09/882,315

(22) Filed: Jun. 15, 2001

(65) Prior Publication Data

US 2002/0190030 A1 Dec. 19, 2002

(51) Int. Cl.[7] ..... H01H 77/00
(52) U.S. Cl. ..... 335/16; 335/8; 335/147
(58) Field of Search ..... 385/16, 147, 195, 385/167–176; 28/22; 335/8–10

(56) References Cited

U.S. PATENT DOCUMENTS 4,342,974 A * 8/1982 Nakano et al. ..... 335/8
4,600,908 A * 7/1986 Uchida et al. ..... 335/8
4,714,907 A 12/1987 Bartolo et al.
4,884,047 A 11/1989 Baginski et al.
4,958,135 A 9/1990 Baginski et al.
5,519,180 A * 5/1996 Zaffetti et al. ..... 200/401
6,064,001 A 5/2000 Ulerich et al.

* cited by examiner

*Primary Examiner*—Lincoln Donovan
(74) *Attorney, Agent, or Firm*—Martin J. Moran

(57) ABSTRACT

A circuit breaker includes a plurality of poles that are connected with one another in parallel, and additionally includes a mutual connection connecting the poles with one another to isolate the trip units associated with the poles from any imbalance in the current flowing through the poles. Each pole includes a first conductor structured to be connected with a power source, a second conductor structured to be connected with an electrical load, and a pair of separable contacts that disconnectably connect the first conductor with the second conductor. The trip unit of each pole is configured to measure the current flowing through a given point of the second conductor, and the mutual connection connects the second conductors together at a connection point, the connection point of each second conductor being between the separable contacts and the given point.

13 Claims, 3 Drawing Sheets

MULTI-POLE CIRCUIT BREAKER WITH PARALLEL CURRENT

BACKGROUND OF THE INVENTION

1. Field of the Invention

The present invention relates generally to circuit breakers and, more particularly, to a multi-pole circuit breaker having a mutual connection connecting the poles with one another at a connection point disposed between the separable contacts and the trip unit of each pole in order to equalize the current that flows through a given point of each pole and that is sensed by the trip unit.

2. Description of the Related Art

Electrical switching apparatus for electric power distribution systems includes circuit breakers and network protectors which provide protection, and electrical switches for isolating parts of the distribution system and for transferring between alternative sources. While families of such switches are produced having a range of current ratings, some applications require higher current ratings than are available from the standard units. It is not practical to make a dedicated switch for such applications in view of the limited demand. It is therefore common to mount a pair of such switches side-by-side and to connect the poles to share the current. It is similarly common to provide a multi-pole circuit breaker and connect the poles thereof together in parallel to similarly share the current. Such a parallel construction technique is of particular value with molded case switches where the required investment in the molded case is quite large and can be alleviated by adjoining multiple circuit breakers together or by combining multiple poles of a multi-pole circuit breaker together. Such parallel circuit breaker configurations have not, however, been without limitation.

For instance, in the example in which the poles of a multi-pole circuit breaker have been connected with one another in parallel, such circuit breakers typically have a single operating mechanism that substantially simultaneously separates the separable contacts of each of the poles to interrupt current flowing through the poles during certain specified conditions. It is understood, however, that such operating mechanisms do not separate all of the sets of separable contacts in a precisely simultaneous fashion. More particularly, it is typically the case that the separable contacts of one particular pole of a multi-pole circuit breaker are invariably the last contacts to separate during operation of the circuit breaker, and the time lag after which the separable contacts of the particular pole separate may be only a fraction of a second. Such a time lag can result from numerous factors, including manufacturing tolerances and imprecision, wear, and other factors.

In a situation in which multiple poles of a circuit breaker are connected with one another in parallel, and during the time lag while cycling the operating mechanism in which all of the sets but one of the separable contacts are separated, all of the current that had been flowing through the multiple poles seeks to travel through the single pole whose separable contacts are still connected with one another. When this last set of separable contacts actually separates, an electrical arc larger than any of the arcs formed across the other sets of separable contacts extends across the final set of opening contacts. Such a large arc has the effect of degrading the contacts due to vaporization of the material of the contacts and other factors. Such degradation of the contacts of the pole reduces the amount of current that can be carried through the pole, such that once the circuit breaker is returned to operation, the poles have an unequal current carrying capability with the result that greater amounts of current travel through some poles than through others.

Each pole of such multi-pole circuit breakers typically includes a trip unit that senses the current flowing through a given point of a conductor of the pole. Such multi-pole circuit breakers additionally include a single operating mechanism that is common to all of the poles and that is operative to separate the sets of separable contacts of the poles. Any of the trip units of the circuit breaker can trigger the operating mechanism to interrupt current flowing through all of the poles when the trip unit detects an overcurrent or under-voltage condition or other condition that warrants a trip operation.

In a situation in which one or more of the sets of separable contacts have experienced some degradation such that each of the poles is carrying different amounts of current therethrough, it is possible that the trip unit connected with the highest current-carrying pole may cause the operating mechanism to trip the entire circuit breaker even though the aggregate current carrying capability of the circuit breaker has not been reached. In effect, therefore, a single trip unit can trip the entire circuit breaker even though neither the circuit breaker on an aggregate basis nor the load is experiencing a condition that would warrant the circuit breaker to trip.

It is thus desired to provide a multi-pole circuit breaker in which the poles thereof are connected in parallel in such a fashion to alleviate the risk of unintended tripping based upon unequal current flow through the pole. It is preferred that such an improved multi-pole circuit breaker include a mutual connection that connects together the poles in such a fashion that the trip units of the poles are isolated from the separable contacts and are not subjected to unequal current flowing through the poles.

SUMMARY OF THE INVENTION

In view of the foregoing, a circuit breaker includes a plurality of poles that are connected with one another in parallel, and additionally includes a mutual connection connecting the poles with one another to isolate the trip units associated with the poles from any imbalance in the current flowing through the poles. Each pole includes a first conductor structured to be connected with a power source, a second conductor structured to be connected with an electrical load, and a pair of separable contacts that disconnectably connect the first conductor with the second conductor. The trip unit of each pole is configured to measure the current flowing through a given point of the second conductor, and the mutual connection connects the second conductors together at a connection point, the connection point of each second conductor being between the separable contacts and the given point.

An aspect of the present invention is to provide a multi-pole circuit breaker having the poles thereof connected with one another in parallel in such a fashion to alleviate the likelihood of undesired tripping of the circuit breaker due to an imbalance in the current flowing through the different poles of the circuit breaker.

Another aspect of the present invention is to provide a multi-pole circuit breaker having an aggregate load-carrying capacity that is substantially unaffected by repeated cycling of the circuit breaker.

Another aspect of the present invention is to provide a multi-pole circuit breaker in which the poles are connected with one another in parallel, and which additionally includes a mutual connection connecting the poles together to substantially equalize the current flowing through the poles at the points where the current flow through each pole is sensed by a trip unit.

Another aspect of the present invention is to provide a circuit breaker, the general nature of which can be stated as including a plurality of poles, each of the poles including a first conductor, a first contact, a second contact, a second conductor, and a trip unit, the first contact being electrically connected with the first conductor, the second contact being electrically connected with the second conductor, the first and second contacts being separably electrically conductively engaged with one another, the trip unit being responsive to current flowing through a given point of the second conductor, each second conductor including a connection point disposed between the second contact and the given point, the first conductors being structured to be connected with a power source, and the second conductors being structured to be connected with an electrical load, an operating mechanism structured to separate the first electrical contacts from the second electrical contacts responsive to the trip units, and an equalization system including a mutual connection that connects together the connection points of the second conductors.

Another aspect of the present invention is to provide an apparatus for use in a multiple pole circuit breaker, each pole including a first conductor, a first contact, a second contact, a second conductor, and a trip unit, the first contact being electrically connected with the first conductor, the second contact being electrically connected with the second conductor, the first and second contacts being separably electrically conductively engaged with one another, the trip unit being responsive to current flowing through a given point of the second conductor, and each second conductor including a connection point disposed between the second contact and the given point, in which the general nature of the apparatus can be stated as including an equalization system including a mutual connection that connects together the connection points of the second conductors.

BRIEF DESCRIPTION OF THE DRAWINGS

A further understanding of the invention can be gained from the following description of the preferred embodiment when read in conjunction with the accompanying drawings in which.

Similar numerals refer to similar parts throughout the specification.

DESCRIPTION OF THE PREFERRED EMBODIMENTS

Figure 1:
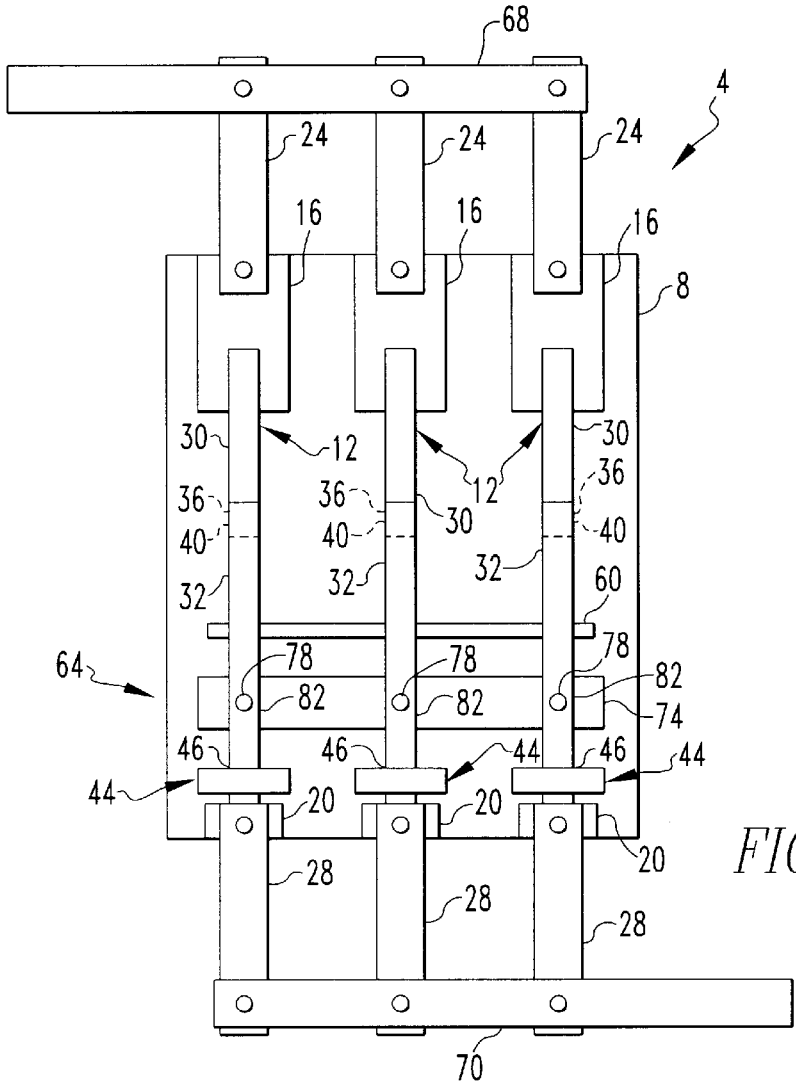
FIG. 1 is a schematic view of a circuit breaker in accordance with the present invention.

A circuit breaker 4 in accordance with the present invention is indicated schematically in FIG. 1. The circuit breaker 4 includes a case 8 housing a plurality of poles 12. As will be set forth more fully below, the poles 12 are connected with one another in parallel to permit the circuit breaker 4 to have an aggregate single phase current carrying capacity across all of the poles 12. While the circuit breaker 4 is depicted as including three poles 12, it is understood that the circuit breaker 4 may include a greater or lesser number of poles 12 without departing from the concept of the present invention.

Each pole 12 terminates at a line terminal 16 at one end thereof, and similarly terminates at a load terminal 20 at the opposite end thereof. The line terminals 16 are structured to be electrically conductively connected with a power source (not shown), and the load terminals 20 are structured to be electrically conductively connected with a load (not shown). It can further be seen that a line connector plate 24 extends outwardly from each line terminal 16 for purposes of connecting the line terminal 16 with the power source. Similarly, a load connector plate 28 extends outwardly from each load terminal 20 to facilitate connection of the load terminal 20 with the load.

Figure 1A:
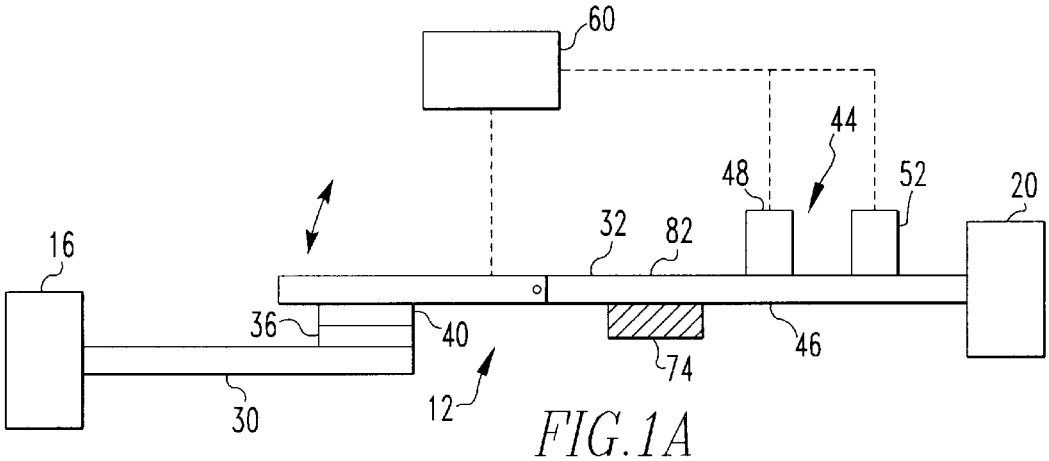
FIG. 1A is a schematic view of a pole of the circuit breaker.

As is best shown in FIG. 1A, each pole 12 includes a first conductor 30, a second conductor 32, a first contact 36, and a second contact 40. The first conductor 30 is connected with the line terminal 16, and the first contact 36 is electrically conductively connected with the first conductor 30 opposite the line terminal 16. The second conductor 32 is connected with the load terminal 20, and the second contact 40 is electrically conductively connected with the second conductor 32 opposite the load terminal 20.

As is known in the relevant art, each pole 12 is structured to conduct current between the line and load terminals 16 and 20 when the first and second contacts 36 and 40 are electrically conductively engaged with one another. The first and second contacts 36 and 40 are separable, however, and such separation of the first and second contacts 36 and 40 interrupts current flowing through the poles 12. As is depicted generally in FIG. 1A, at least a portion of the second conductor 32 is movable to cause the second contact 40 to be movable away from and separable from the first contact 36. It is understood that the poles 12 may be of other configurations than that depicted schematically in FIG. 1A without departing from the concept of the present invention.

As is further depicted schematically in FIG. 1A, each pole 12 further includes a trip unit 44 that is structured to measure the current flowing through a given point 46 of the second conductor 32 and to responsively generate a signal or other response in the event of certain specified conditions. The specified conditions may include one or more of overcurrent conditions, under-voltage conditions, fault conditions, or other conditions that warrant the interruption of current.

Each trip unit 44 of the circuit breaker 4 includes a bimetal strip 48. The bimetal strip 48 is responsive to overcurrent conditions of a specified duration. As is understood in the relevant art, the trip unit 44 may be of numerous other configurations depending upon the specific needs of the particular application without departing from the concept of present invention.

The trip units 44 of all of the poles 12 are connected with a single operating mechanism 60 that is operative to substantially simultaneously separate the sets of first and second contacts 36 and 40 of all of the poles 12 with the circuit breaker 4. The operating mechanism 60 responsively separates the first and second contacts 36 and 40 from one another according to a signal or other response from any trip unit 44 of any pole 12 to a specified condition on the pole 12. In this regard, it is understood that the trip unit 44 of any of the poles 12 can trigger the operating mechanism 60 to interrupt the current flowing through all of the poles and, in effect, to shut down the circuit breaker 4.

As indicated above, the poles 12 of the circuit breaker 4 are connected with one another in parallel. In this regard, the circuit breaker includes an equalization system 64 that connects the poles 12 in parallel in such a fashion that the trip units 44 are substantially isolated from any inequality of current flowing through the poles 12 that may result from a set of first and second contacts 36 and 40 of a given pole 12 being worn or degraded to a greater degree than the first and second contacts 36 and 40 of the other poles 12.

The equalization system 64 includes a first bus bar 68 connecting the line connector plates 24 to one another, a second bus bar 70 connecting the load connector plates 28 to one another, and a mutual connection 74 that connects the second conductors 32 to one another. The first and second bus bars 68 and 70 each function as connections that electrically conductively connect together the line side and the load side of the poles 12 in order to connect the poles 12 in parallel with one another. The mutual connection 74 connects the second conductors 32 with one another to substantially isolate the trip units 44 of the poles 12 from any imbalance in current flowing through the individual poles 12. More specifically, each second conductor 32 includes a connection point 82, and the connection points 82 are connected with one another by the mutual connection 74. Each second conductor 32 includes a load conductor portion defined thereon that extends from the given point 46 in a direction away from the connection point 82.

In the embodiment depicted in FIG. 1, the mutual connection 74 is in the form of a bus bar that is connected by a fastener 78 with each connection point 82. It is understood that the mutual connection 74 may be of other configurations, such as a flexible member or in the form of a specific configuration of the second conductors 32 themselves that causes them to mutually interconnect with one another at the connection points 82. Likewise, the first and second bus bars 68 and 70 can be replaced with other types of connections such as flexible wires or other types of connections. Additionally, it can be seen that other configurations of the circuit breaker 4 may include an equalization system having only the mutual connection 74.

As can be seen in FIG. 1, the trip units 44 are each configured to measure or otherwise sense the current flowing substantially through the given points 46 of the second conductors 32, and it can further be seen that the connection points 82 at which the second conductors 32 are electrically conductively connected with one another are disposed between the given points 46 and the second contacts 40. It thus can be seen that the trip units 44 of the poles 12 are electrically disposed between the mutual connection 74 and the second bus bar 70 such that any imbalance in current flow through the individual poles 12 resulting from differing levels of degradation in the sets of first and second contacts 36 and 40 will be advantageously equalized by the mutual connection 74. Stated otherwise, by interposing the mutual connection 74 between the trip units 44 and the sets of first and second contacts 36 and 40, if the current flowing through the poles 12 between the line terminals 16 and the connection points 82 is imbalanced, the mutual connection 74 electrically conductively connects the connection points 82 with one another to advantageously equalize the current flowing through the second conductors 32 between the connection points 82 and the load terminals 20, and thus equalizes the current flowing through the given points 46.

By isolating the trip units 44 from the sets of first and second contacts 36 and 40, and by resultingly equalizing the current flowing through the given points of the second conductors 32, the circuit breaker 4 does not undesirably trip prior to reaching the aggregate current rating of the circuit breaker 4. More specifically, in the absence of the mutual connection 74, the circuit breaker 4 may have an imbalance in the current flowing through the poles 12 such that the trip unit 44 of the pole 12 having the greatest current flow may signal the operating mechanism 60 to trip the circuit breaker 4 even though the aggregate current rating of the circuit breaker 4 has not been reached. As such, by including the mutual connection 74 that connects the connection points 82 of the second conductors 32, the circuit breaker 4 overcomes the effect of current imbalance within the poles 12 by isolating the trip units 44 from such imbalance.

It is further understood that the mutual connection 74 can connect fewer than all of the poles 12 of the circuit breaker 4 in parallel, and can alternatively, or in additional thereto, connect one or more of the poles 12 of the circuit breaker 4 with one or more poles of a separate circuit breaker 4. In still other configurations, it may be desirable to provide a first mutual connection 74 connecting two or more poles 12 with one another, and to additionally provide a second separate mutual connection 74 that connects two or more other poles 12 of the same or another circuit breaker 4 in parallel, depending upon the specific needs of the particular application. It thus can be seen that the mutual connection 74 can be provided in numerous different types of configurations with single or multiple circuit breakers 4 depending upon the specific needs of the particular application.

Figure 2:
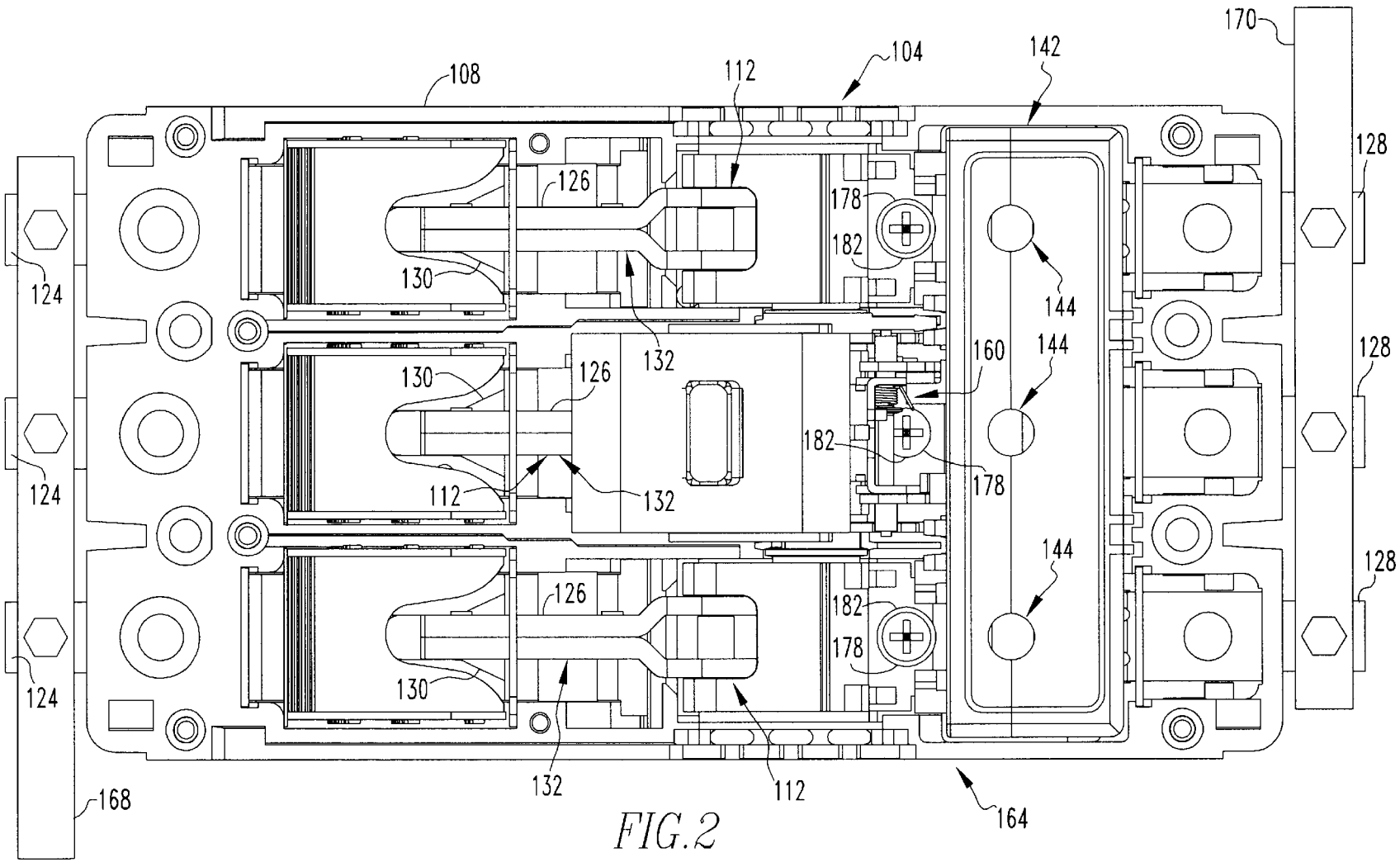
FIG. 2 is a top plan view of an embodiment of a circuit breaker in accordance with the present invention.
Figure 3:
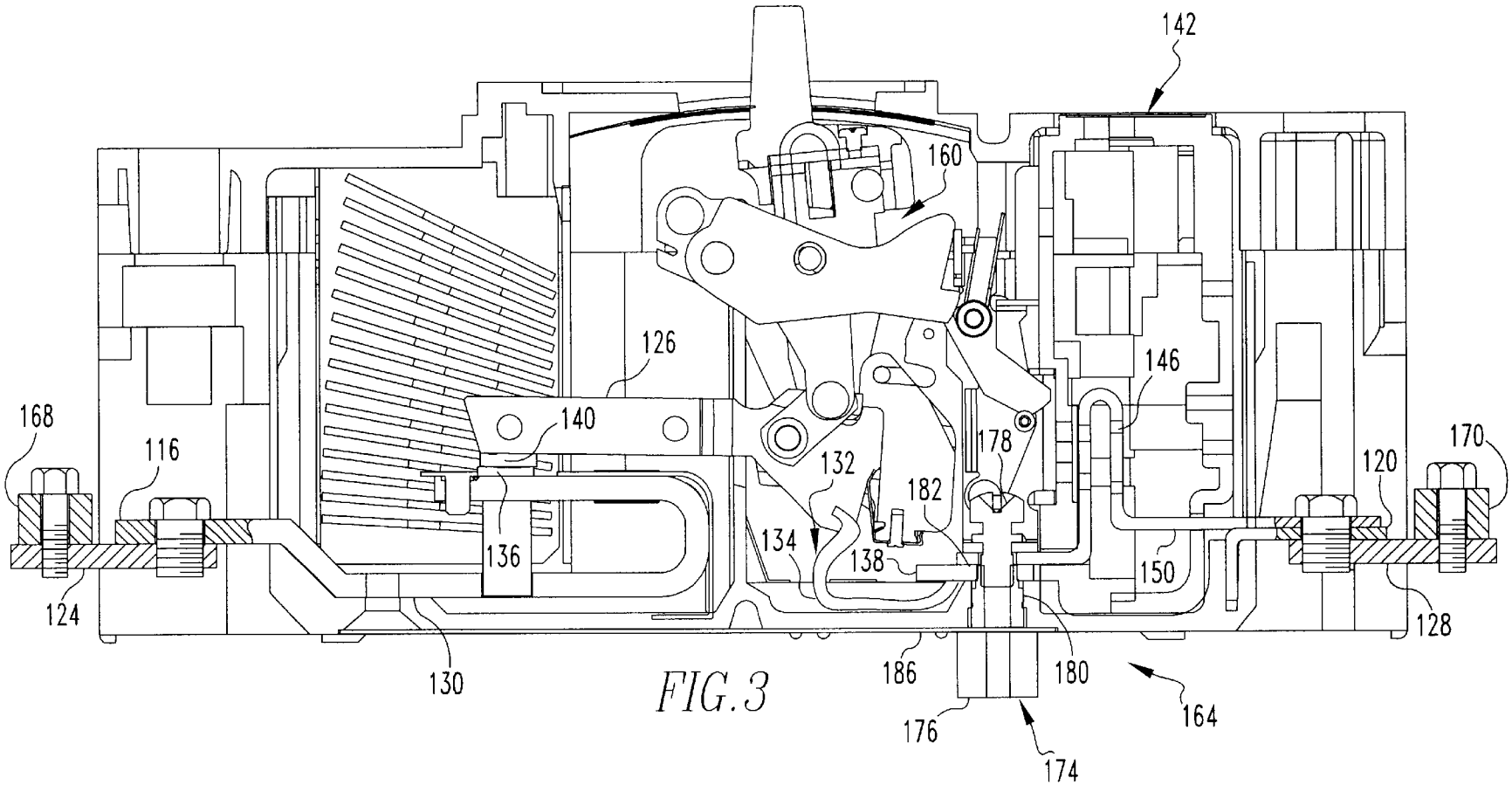
FIG. 3 is a side elevational view of the circuit breaker depicted generally in FIG. 2.

Another embodiment of a circuit breaker 104 in accordance with the present invention is indicated generally in FIGS. 2 and 3. The circuit breaker 104 includes a case 108 upon which are mounted three poles 112 that are connected in parallel. Each pole 112 includes a line terminal 116 and a load terminal 120 that are mounted or otherwise disposed on the case 108. A line connector plate 124 extends outwardly from each line terminal 116, and a load connector plate 128 extends outwardly from each load terminal 120.

Additionally, each pole 112 includes a first conductor 130, a second conductor 132, a first contact 136, and a second contact 140. Each first conductor 130 electrically conductively extends between the line terminal 116 and the first contact 136 of the pole 112. Each second conductor 132 electrically conductively extends between the second contact 140 and the load terminal 120 of the pole 112.

The circuit breaker 104 additionally includes a trip apparatus 142 that includes three trip units 144, whereby one of the trip units 144 is operatively connected with each pole 112. Each trip unit 144 includes a bimetal strip (not shown) and a magnetic trip (not shown) that are operative to interrupt current flowing through the circuit breaker 104 upon the occurrence of certain specified conditions. It is understood that the trip apparatus 142 and the tip units 144 may be of other configurations and may incorporate other trip features or accessories without departing from the concept of the present invention.

As is best shown in FIG. 3, the second conductor 132 of each pole 112 includes a movable arm 126 upon which the second contact 140 is mounted, a flexible conductor 134 that flexibly extends between the movable arm 126 and a mounting plate 138, and a trip conductor 150 that extends through the trip unit 144 between the mounting plate 138 and the load terminal 120. It can be seen that the movable arm 126 is operatively connected with an operating mechanism 160 that is common to all of the poles 112 of the circuit breaker 104. It can further be seen that the given point 146 at which the current traveling through the second conductor 132 is detected or measured is disposed on the trip conductor 150.

From FIGS. 2 and 3, it can be seen that the circuit breaker 104 includes an equalization system 164 in accordance with the present invention that includes a first bus bar 168, a second bus bar 170 and a mutual connection 174. The first bus bar 168 electrically conductively connects the line connector plates 124 with one another, and the second bus bar 170 electrically conductively connects the load connector plates 128 with one another. It thus can be seen that the first and second bus bars 168 and 170 connect the poles 112 with one another in parallel. It is further understood that the first and second bus bars 168 and 170 serve as first and second connections that can be of other configurations such as flexible conductors or specific arrangements of the line and load connector plates 124 and 128.

In accordance with the present invention, the mutual connection 174 electrically conductively connects a connection point 182 on each second conductor 132 with one another. In the depicted embodiment, the mutual connection 174 includes a substantially rigid extension member 176 and a plurality of conductive bosses 180, with one of the conductive bosses 180 being electrically conductively connected with each connection point 182. More specifically, the connection points 182 are defined on the mounting plates 138 of the poles 112, and thus each conductive boss 180 is electrically conductively engaged with one of the mounting plates 138.

Such electrically conductive engagement is provided by a fastener 178 that is depicted in FIGS. 2 and 3 as being a flanged screw that is threaded. Each conductive boss 180 is cooperatively threaded such that the fasteners 178 are threadably engagable with the conductive bosses 180 to electrically conductively engage the conductive bosses 180 with the connection points 182 of the second conductors 132. In such a fashion the mutual connection 174 substantially isolates the trip units 144 from any imbalance in the current flowing through the poles 112 that result from uneven wear of the first and second contacts 132 and 140 of any of the poles 112, in a manner set forth above.

It can further be seen that the connection points 182 are advantageously disposed between the second contacts 140 and the given points 146 of the second conductors 132. The mutual connection 174 thus substantially isolates the trip units 144 from imbalance in current flowing through the poles 112 that may result from uneven wear of the first and second contacts 136 and 140 of the poles 112. It is understood that the mutual connection 174 may be of other configurations than that specifically shown in FIGS. 2 and 3 and discussed above. For instance, the mutual connection 174 may not include the conductive bosses 180, and in addition thereto, or alternatively, may include an extension number 176 that is of a flexible nature or of another configuration without departing from the concept of the present invention.

The circuit breaker 104 thus includes a mutual connection 174 that is disposed on an outer surface 186 of the case 108 yet includes the conductive bosses 180 that extend from the extension number 176 into the interior of the circuit breaker 104 and electrically conductively connect the second conductors 132 with one another. It is understood, however, that other circuit breakers in accordance with the present invention may be of other configurations than that specifically set forth above and depicted in the accompanying figures without departing from the concept of the present invention.

While particular embodiments of the present invention have been described herein, it is understood that various changes, additions, modifications, and adaptations may be made without departing from he scope of the present invention, as set forth in the following claims.

What is claimed is:

1. A circuit breaker comprising:

a plurality of poles;

each of the poles including a first conductor, a first contact, a second contact, a second conductor, and a trip unit, the first contact being electrically connected with the first conductor, the second contact being electrically connected with the second conductor, the first and second contacts being separably electrically conductively engaged with one another, the trip unit generating a trip signal in response to a specified condition of the current flowing through a given point of the second conductor, each second conductor including a connection point disposed between the second contact and the given point, the first conductors being structured to be connected with a power source, and the second conductors being structured to be connected with an electrical load;

an operating mechanism structured to separate the first electrical contacts from the second electrical contacts responsive to the trip signal from at least one of the trip units; and an equalization system including a mutual connection that electrically conductively connects together the connection points of the second conductors.

2. The circuit breaker as set forth in claim 1, in which the second conductors each include a load conductor portion that extends from the given point in a direction away from the connection point, and in which the equalization system includes a first connection that electrically conductively connects together one of the set of load conductor portions and the set of first conductors.

3. The circuit breaker as set forth in claim 2, in which the first connection is a first bus bar.

4. The circuit breaker as set forth in claim 2, in which the first connection electrically conductively connects the set of first conductors together, and in which the equalization system further includes a second connection that electrically conductively connects together the set of load conductors.

5. The circuit breaker as set forth in claim 4, in which the first connection is a first bus bar and the second connection is a second bus bar.

6. The circuit breaker as set forth in claim 1, in which the mutual connection is one of a flexible member and a substantially rigid connection bar.

7. The circuit breaker as set forth in claim 6, in which the mutual connection is a substantially rigid connection bar.

8. An apparatus for use in a multiple pole circuit breaker, each pole including a first conductor, a first contact, a second contact, a second conductor, and a trip unit, the first contact being electrically connected with the first conductor, the second contact being electrically connected with the second conductor, the first and second contacts being separably electrically conductively engaged with one another, the trip unit being responsive to current flowing through a given point of the second conductor, and each second conductor including a connection point disposed between the second contact and the given point, the apparatus comprising;

an equalization system including a mutual connection that electrically conductively connects together the connection points of the second conductors.

9. The apparatus as set forth in claim 8, in which the second conductors are structured to each include a load conductor portion that extends from the given point in a direction away from the connection point, and in which the equalization system further includes a first connection that is structured to electrically conductively connect together one of the set of load conductor portions and the set of first conductors.

10. The apparatus as set forth in claim 9, in which the first connection is structured to electrically conductively connect together the set of first conductors, and in which the equalization system further includes a second connection that is structured to electrically conductively connect together the set of load conductors.

11. The apparatus as set forth in claim 10, in which the first connection is a first bus bar and the second connection is a second bus bar.

12. The apparatus as set forth in claim 8, in which the mutual connection is one of a flexible member and a substantially rigid connection bar.

13. The apparatus as set forth in claim 12, in which the mutual connection is a substantially rigid connection bar.

* * * * *